US006643956B2

(12) United States Patent
Mawusi et al.

(10) Patent No.: US 6,643,956 B2
(45) Date of Patent: Nov. 11, 2003

(54) ORTHOPEDIC SLIPPER

(76) Inventors: Earnest P. S. Mawusi, 304 Marcella Rd., Suite A, Hampton, VA (US) 23666; Calvin S. Kibwe, 6 Tindalls Way, Hampton, VA (US) 23666

( * ) Notice: Subject to any disclaimer, the term of this patent is extended or adjusted under 35 U.S.C. 154(b) by 0 days.

(21) Appl. No.: 09/892,659

(22) Filed: Jun. 28, 2001

(65) Prior Publication Data

US 2001/0034956 A1 Nov. 1, 2001

Related U.S. Application Data

(63) Continuation of application No. 09/349,195, filed on Jul. 7, 1999, now abandoned.
(60) Provisional application No. 60/091,915, filed on Jul. 7, 1998.

(51) Int. Cl.[7] ..... A61F 5/14
(52) U.S. Cl. ..... 36/140; 36/9 R; 36/88; 36/26; 36/55
(58) Field of Search ..... 36/9 R, 4, 11, 36/8.3, 88, 93, 102, 103, 10, 26, 30 R, 32 R, 140, 55

(56) References Cited

U.S. PATENT DOCUMENTS

| | | | |
|---|---|---|---|
| 4,542,598 | A | 9/1985 | Misevich et al. |
| 4,934,073 | A | 6/1990 | Robinson |
| 5,012,541 | A | 5/1991 | Ganon |
| 5,035,069 | A | 7/1991 | Minden |
| 5,189,814 | A | 3/1993 | Barma |
| 5,469,641 | A | 11/1995 | Subotic |
| 5,553,399 | A | 9/1996 | Strong |
| 5,733,647 | A | 3/1998 | Moore, III et al. |
| 5,743,027 | A | 4/1998 | Barma |
| 5,829,171 | A | 11/1998 | Weber et al. |
| 5,994,245 | A | 11/1999 | Marier et al. |

*Primary Examiner*—Anthony D. Stashick
(74) *Attorney, Agent, or Firm*—Banner & Witcoff, Ltd.

(57) ABSTRACT

A slipper for use by people with normal foot anatomy or with mild malady i.e., bunions, hammertoes and other bony prominences. The slipper is fabricated to have a mild rocker bottom sole with mild flexibility, allowing the wearer to roll through the gait cycle. A long firm medial counter, is in place, giving greater support and decreasing pronatory forces.

14 Claims, 2 Drawing Sheets

ORTHOPEDIC SLIPPER

This application is a continuation of U.S. application Ser. No. 09/349,195, filed Jul. 7, 1999 Abandoned.

CLAIM OF PRIORITY TO PRIOR APPLICATION

This application claims priority to Provisional Application Serial No. 60/091,915 filed Jul. 7, 1998.

BACKGROUND OF THE INVENTION

The present invention is generally related to the field of protective footwear and more specifically, is directed to an orthopedic slipper for suffers of diabetes, neuropathy, arthritis, peripheral vascular disease and anyone else desiring safe indoor footwear.

According to current data from the American Diabetes Association, over 16 million people in the United States have diabetes, and about 1,800 new cases are diagnosed of the disease every day. In addition, the National Institute of Diabetes and Digestive and Kidney Diseases have stated that, at least 15% (2.4 million) of all people with diabetes eventually develop foot ulcers. It is believed that this condition leads to an estimated 40,000 surgical amputations every year. It is also estimated that cardiovascular disease contributes an additional 20,000 surgical amputations years.

The World Health Organization (WHO) estimates that over 160 million people, worldwide suffer from some form of diabetes. Diabetics are especially prone to foot ulcers (an open cut or wounds on the feet), that may become seriously infected and possibly necessitate surgical amputation. In diabetics, once foot ulcer develops, they are difficult to treat. In fact, a diabetic patient may not be aware of any foot wounds because of sensory neuropathy, a nervous system disorder that restricts the ability to feel pain, particularly in the feet and legs. By the time such wounds are discovered, foot amputation may be the only solution to prevent fatality.

Poorly controlled diabetes may also lead to cardiovascular disease, a common complication that restricts blood circulation, especially to the lower legs. This means cuts and other foot injuries heal very slowly and become receptive to serious infection which may in turn lead to surgical amputation.

As a result of the two complications described above, estimated 60,000 surgical foot amputations are carried out each year, the cost of such procedures exceed $100 billion annually. Other known effects of foot ulcers and cardiovascular disease are disability, prolonged hospitalization, strokes and in certain cases death.

It is estimated that nearly three quarters of foot amputations could be prevented with proper foot care. Thus, a great deal of expense, medical suffering and anguish could be saved or eliminated altogether if diabetes patients protected themselves from the minor accidents that occur in and out of their homes.

Even though outdoor accidents are prevented by most of the protective shoes in the market today, research has shown that no protective shoes exist for indoor wear. These outdoors special shoes may be capable of preventing injuries to the foot outside the homes, they are not adaptable for indoor wear, and even if adaptable, they are very expensive to the average diabetic. Emphasis is often placed on glamour rather than medical needs and comfort ability of the patients.

There have been a number of attempts in the prior art to address the problems noted above with respect to diabetics and their foot care needs. For example U.S. Pat. No. 5,491,909, which issued in the name of Darby, discloses a shock absorbing medical shoe. However, the shoe is open toed and therefore can not serve to protect the entire foot from accidental injury. There also is no firm medial counter for reducing abnormal pronatory forces. Moreover, the shoe does have a moldable insole and thus, can not conform to the foot that wears it.

U.S. Pat. No. 5,566,479, which issued in the name of Gray et al., is directed to a shoe construction for use by diabetic persons. While an improvement over the Darby design with respect to providing more complete protection for the foot, the shoe disclosed by the Gray patent remains deficient in a number of areas. For example, the shoe is not designed for indoor use and is not designed to conform to the wear's foot.

U.S. Pat. No. 5,545,129, which issued in the name of Snook merely discloses a supportive foot cushion. Thus, it does not cover the entire foot which is required in order to provide complete foot protection.

Accordingly, there exists a need to provide orthopedic footwear which is better suited for diabetics and other suffers of foot conditions than footwear currently known in the art.

SUMMARY OF THE PRESENT INVENTION

Accordingly, it is an objective of the present invention to obviate the above-noted shortcomings and disadvantages of present orthopedic shoes and related devices.

It is a further objective of the present invention to provide an orthopedic slipper which is easy and convenient to use. It is a still further objective of the present invention to provide an orthopedic slipper which is economical to make and simple to use.

It is a further objective of the present invention to provide an orthopedic slipper which is more economical than prior art approaches.

It is a still further objective of the present invention to provide an orthopedic slipper which protects the entire foot from accidental injury.

It is another objective of the present invention to provide an orthopedic slipper which conforms to the wear's foot.

The present invention provides a novel and unobvious slipper for use by people with normal foot anatomy or with mild malady i.e., bunions, hammertoes and other bony prominences. The slipper is fabricated to have a mild rocker bottom sole with mild flexibility, allowing the wearer to roll through the gait cycle. A long firm medial counter, is in place, giving greater support and decreasing pronatory forces.

Other features include a non-penetrable and anti-skid outer sole, lambs wool inner lining along with a body heat moldable insole that contours to the foot. Also, there is a high, firm protective, closed toe box, preventing stubbing or blunt injuries.

Lastly, the slipper is light weight and has firm protective sides. The upper material, outer wall of Applicants' slipper can be made of any durable, breathable, stable, protective material. Inner lining must be made of breathable, non-irritating, protective material, like lambs wool or non-irritating synthetics and or plastizote materials. The expandable gores allow for swelling and easy access for the elderly and the arthritic. There is also a padded full-length upper heel collar for protection of the Achilles tendon and malleolar regions. There are no straps, laces or buckles for easy access into the slipper and this helps to provide even distribution of pressure Applicants' slipper provides substantial novel and unobvious improvements over the so-called orthopedic shoes and footwear know in the prior art. For example, the primary objective of the medical shoe disclosed in the Darby patent is to provide footwear protection and support following surgery or other injuries to the foot when normal footwear can not be worn. The primary objective of the orthopedic slipper of the present invention is to provide protective, comfortable, custom, indoor, footwear for the diabetic and any other group, at risk for skin ulcers that can lead to limb loss.

The shoe disclosed in the Gray patent is not a slipper and is not designed for indoor use. There is no heat (body) moldable insole which allows the shoe to better conform to the wearer's foot. The purpose of the Gray invention is to provide relief areas in the shoe that have sensors on them to alert the wearer if there is too much pressure. This shoe does not protect the wearer from blunt injuries.

The Snook cushion is clearly not a slipper. It is not intended to cover the entire foot. The cushion does not make a permanent impression of the wearer's foot because of its memory. The orthopedic slipper of Applicants' invention, however, includes a plastizote combination that will be protective to the wearer and give a custom impression of their foot.

In summary each of the above patents are intended to be worn by a person having some form of foot abnormality. The diabetic orthopedic slipper of the present invention can be worn by diabetics with or without neuropathy, arthritis, peripheral vascular disease and the general population with a normal foot.

BRIEF DESCRIPTION OF THE DRAWINGS

The novel features of the present invention are set out with particularity in the appended claims, but the invention will be understood more fully and clearly from the following detailed description of the invention as set forth in the accompanying drawings in which:

DESCRIPTION OF THE PREFERRED EMBODIMENT

Applicants' have designed a home slipper that can protect the feet from most accidents that occur around the home and yet feel very comfortable to wear in all respect. The knowledge of the human foot and the requirements of the diabetic patients have afforded the Applicants the ability to apply the latest footwear components to achieve a novel and unobvious slipper which is far superior to orthopedic shoes and related device known in the art.

Figure 1:
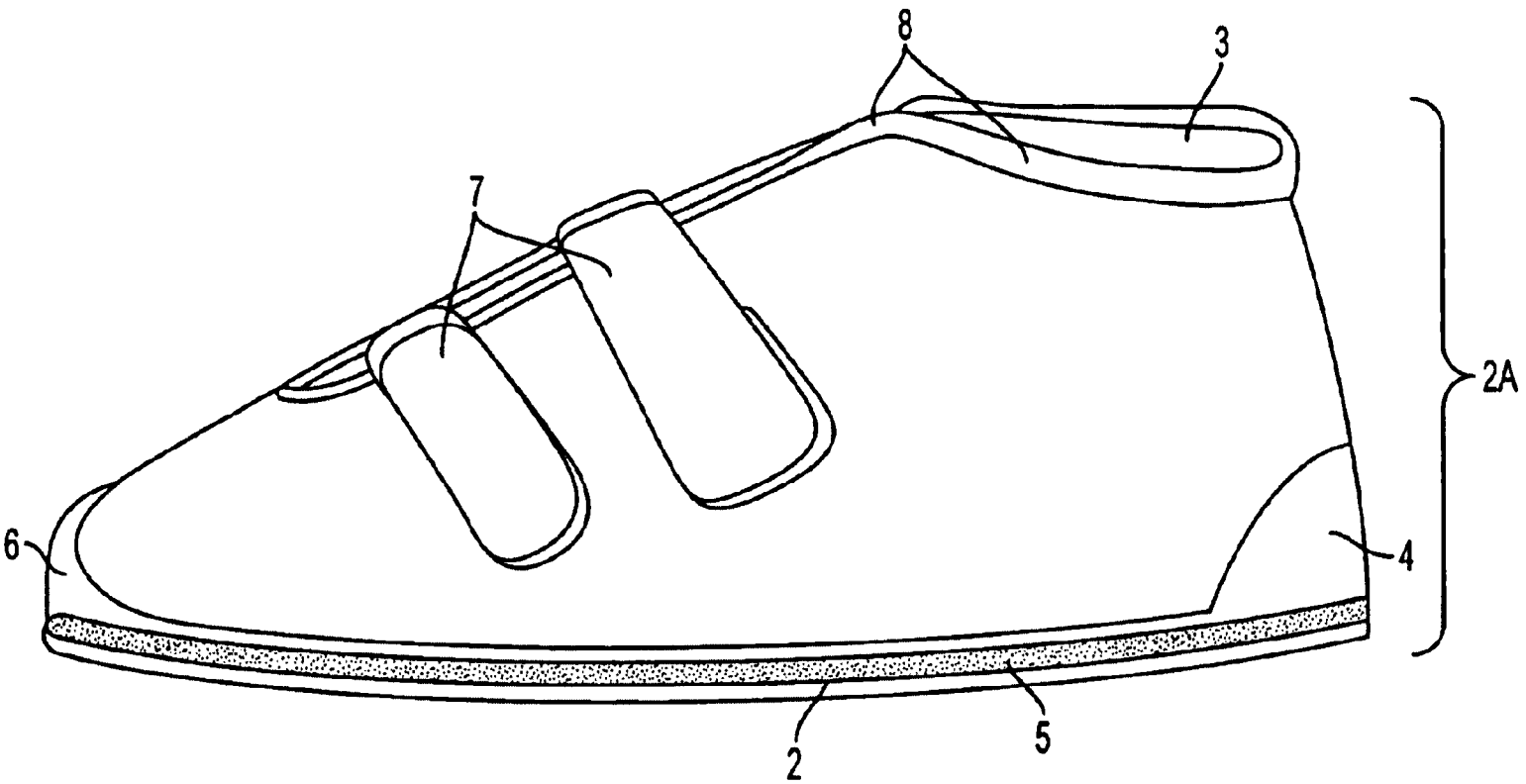
FIG. 1 is a side view of one embodiment of a slipper in accordance with Applicants' invention.

As shown in FIG. 1, the slipper of Applicants' invention includes an upper 1 and a bottom 2. Upper 1 is the portion of the slipper which covers the foot while bottom 2 is the part of the slipper which interfaces between the foot and the ground or floor.

In accordance with one embodiment of the present invention, upper 1 is made of a soft material such as, for example, soft leather, spandex or any other breathable material. The slipper also includes a double density plastizote inner linings 3 which provides optimum comfort. Heel counter 4 is made of a firm material, such as corrugated or compressed paper or celastic to stabilize the heel, reduce heel drift and minimize rollover while weight bearing.

Sole 5 of the slipper is made of material that is slip resistant and proves semi-impenetrable to such objects as needles, pins, tacks, wood splinters, glass and most common household objects that are sharp. Such materials include crepe and/or various thicknesses of rubber, both vulcanized and un-vulcanized. Toe box 6 of the slipper provides ample forefoot room and protect the foot from objects accidentally dropped on the foot, stepping on the toes and stubbing.

Throat 8 of the slipper is secured by a pair of Velcro fasteners 7.

In spite of the all round protection offered the foot, the slipper of applicants' invention is extraordinarily light in weight, approximately ⅛" and offers remarkable foot movement. The concavity will be filled with, for example, a poron material to provide a surface platform.

The slippers of Applicants' invention are designed specially for the needs of the diabetic patient. The slippers provide complete protection for the wearer's foot and are a great improvement over so-called orthopedic shoe known in the prior art.

Figure 2:
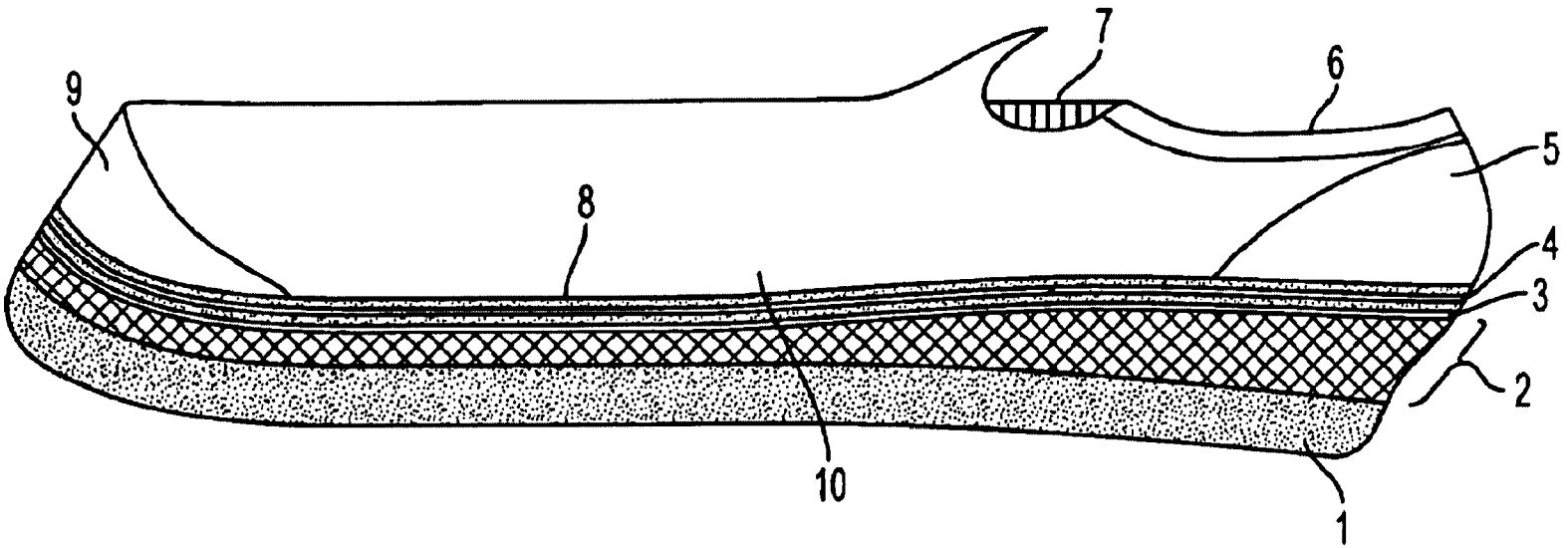
FIG. 2 is a side/cross-section view of another embodiment of a slipper in accordance with Applicants' invention.

FIG. 2 illustrates another embodiment of the slipper in accordance with the present invention. In this embodiment, the slipper is formed of an outer sole 1 of approximately 0.5 to 0.8 cm in thickness. Outer sole 1 can be made of crepe or vulcanized or non-vulcanized rubber which is semi-impenetrable. Attached to outer sole 1 is a three-layer mid-sole. The first layer 2 is made of ethylene vinal acetate material. The thickness of layer 2 can range between 0.5 cm to 1.0 cm. A second layer 3 is formed on top of layer 2 and is formed of a poron material of approximately 1/32 inch. Third layer 4 is formed on top of second layer 3 and also is formed of poron material of approximately 0.5 cm in thickness. A heat moldable insole 8 which carries body 10 of the slipper is attached to third layer 4. Insole 8 may also be made of a poron material and body 10 may be made of lambs wool or any breathable non-absorbing material.

The slipper illustrated in FIG. 2 also includes a heel counter 5 made of a firm material and a padded collar 6 made of a soft material. Heel counter 5 may be made of a light weight, but firm, protective material such as corrugated or compressed paper or celastic. An expandable gore 7 also is provided along with a firm toe box 9. Toe box 9 may be made of the same material as heel counter 5.

It should be obvious from the above-discussed apparatus embodiment that numerous other variations and modifications of the apparatus of this invention are possible, and such will readily occur to those skilled in the art. Accordingly, the scope of this invention is not to be limited to the embodiment disclosed, but is to include any such embodiments as may be encompassed within the scope of the claims appended hereto.

We claim:

1. An orthopedic slipper, said slipper comprising:

an upper portion formed of a breathable material and adapted for covering an upper portion of the foot of a wearer of said slipper;

an inner lining formed under said upper portion, said inner lining being made of a double density material;

a lower portion attached to said upper portion, said lower portion serving as an interface between the foot of a wearer of said slipper and the surface on which said slipper rest, said lower portion including a sole;

a heel counter attached to the rear of said upper portion and said lower portion, said heel counter being made of a firm material adapted to reduce heel drift; and fastening means attached to said upper portion for securing said slipper on the foot of a wearer.

2. The orthopedic slipper of claim 1, wherein said upper portion is made of a leather material.

3. The orthopedic slipper of claim 1, wherein said upper portion is made of a spandex material.

4. The orthopedic slipper of claim 1, wherein said lining is made of a plastizote material.

5. The orthopedic slipper of claim 1, wherein said heel counter is further made of a material adapted to minimize rollover while bearing weight.

6. The orthopedic slipper of claim 5, wherein said heel counter is made of corrugated paper.

7. The orthopedic slipper of claim 5, wherein said heel counter is made of compressed paper.

8. The orthopedic slipper of claim 5, wherein said heel counter is made of celastic.

9. The orthopedic slipper of claim 1, wherein said inner lining is positioned immediately adjacent said upper portion.

10. The orthopedic slipper of claim 1, wherein said sole is made of slip resistant material.

11. The orthopedic slipper of claim 1, wherein said sole is made of a material impenetrable to sharp objects.

12. The orthopedic slipper of claim 11, wherein said sole is made of vulcanized rubber.

13. The orthopedic slipper of claim 11, wherein said sole is made of un-vulcanized rubber.

14. The orthopedic slipper of claim 1, wherein said fastening means is formed of a plurality of hook and loop fasteners.

* * * * *